United States Patent [19]

Parrillo et al.

[11] 4,103,403

[45] Aug. 1, 1978

[54] TENTER GUIDE RAIL GAP CROSSING MECHANISM

[75] Inventors: Henry Parrillo, Johnston; John Sherman Harrington, Warwick; Glenn Howard Curtis, North Kingstown, all of R.I.

[73] Assignee: Marshall and Williams Company, Providence, R.I.

[21] Appl. No.: 524,550

[22] Filed: Nov. 18, 1974

[51] Int. Cl.[2] ..... D06C 3/04

[52] U.S. Cl. ..... 26/91

[58] Field of Search ..... 26/57 R, 61 A, 61 B, 26/91

[56] References Cited

U.S. PATENT DOCUMENTS

| | | | |
|---|---|---|---|
| 3,179,976 | 4/1965 | Nash | 26/61 B X |
| 3,179,977 | 4/1965 | Nash | 26/61 B UX |
| 3,303,528 | 2/1967 | Gageur et al. | 26/57 R |
| 3,457,608 | 7/1969 | Gageur | 26/61 B |
| 3,490,094 | 1/1970 | Pfeffer, Jr. | 26/61 B X |
| 3,598,371 | 8/1971 | Hyatt | 26/61 B X |

FOREIGN PATENT DOCUMENTS

| | | | |
|---|---|---|---|
| 694,192 | 7/1940 | Fed. Rep. of Germany | 26/57 R |
| 1,201,123 | 8/1970 | United Kingdom | 26/61 B |

*Primary Examiner*—Robert R. Mackey
*Attorney, Agent, or Firm*—William Frederick Werner

[57] ABSTRACT

This invention relates to tenter frames and more particularly to a tenter rail provided with a gap crossing mechanism whereby the tenter clip engaging surfaces of the tenter guide rails, at the rail joints, are smooth for the gentle passage of the tenter clips arranged in a chain.

1 Claim, 20 Drawing Figures

130
198
90
192
247
194
201
190
203
191
193
202
204
200
199
15A 170
171
302
300
198
130
190A
90

130
198
90
91
81
69A
300
253
140A
147
302A
141A
171A
143A
67A
170A
142A
255
148
257
259
256
260
254
252
145A
258
251
226A
15A 130
196
90
192
195
198
191
194
193
190

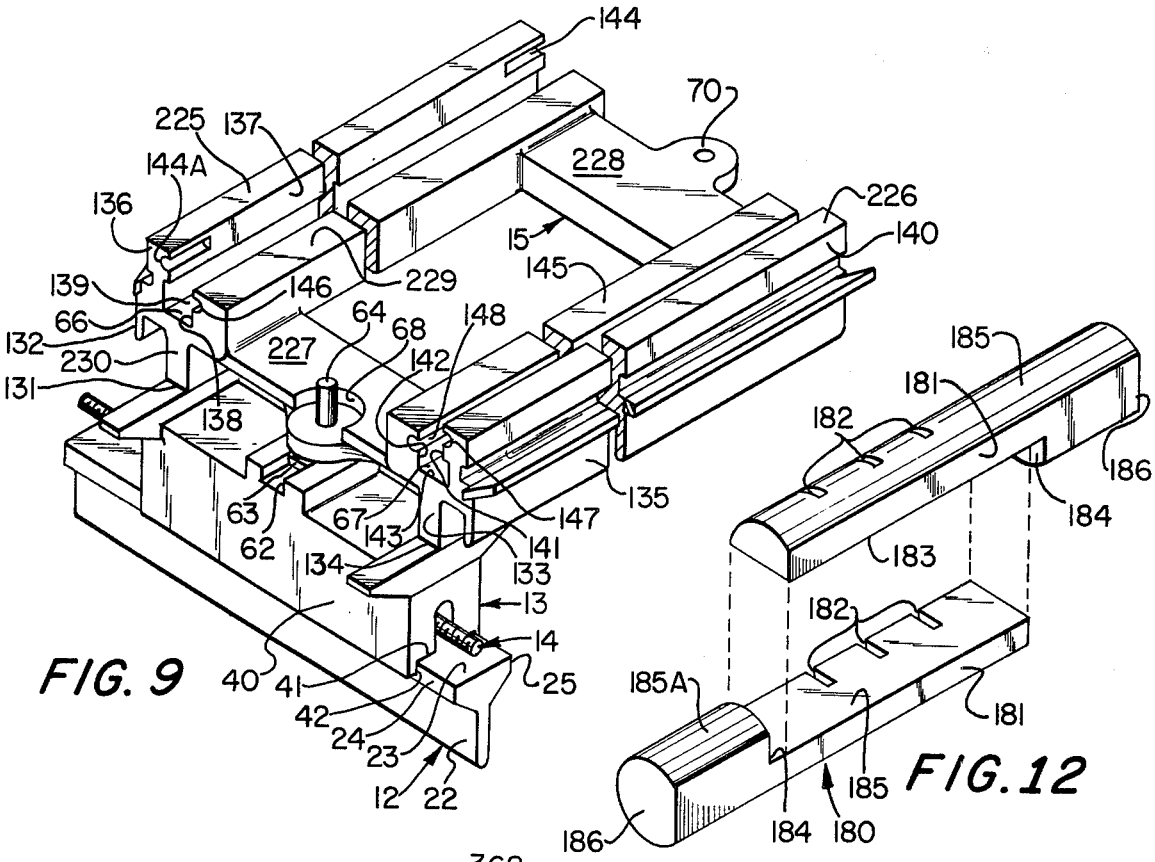
FIG. 9
FIG. 12
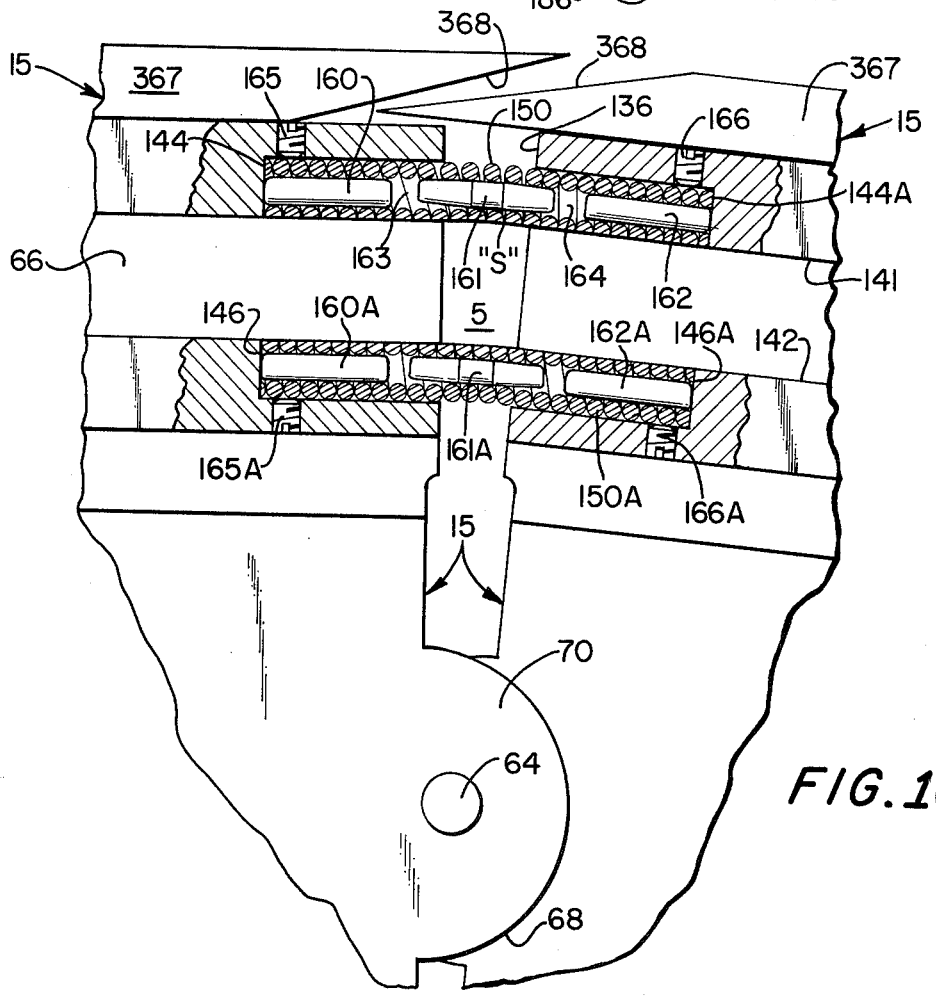
FIG. 10

TENTER GUIDE RAIL GAP CROSSING MECHANISM

STATEMENT OF INVENTION

This invention relates to tenter frames and more particularly to means between guide rail joints which provide a smooth path of travel for the tenter clips arranged in a chain.

BACKGROUND OF THE INVENTION

Tenter frames are commonly employed in web treating processes of the textile and thermoplastic film manufacturing industries.

Such frames consist of a multiple number of guide rails pivotally connected together. Each guide rail has opposite and parallel guide surfaces which provide a working surface and a return surface for an endlessly moving tenter clip chain.

Each tenter frame consists of two oppositely located guide rails. Two saddles, one for each guide rail, are slidably mounted upon a cross member of the machine frame. A shaft having a left hand thread and a right hand thread is rotatably mounted to the cross member. The two saddles are, respectively, connected to the left hand thread and the right hand thread. Rotation of the shaft moves the two saddles toward and away from each other to decrease or increase the distance between the two oppositely located saddles and guide rails. This movement causes adjacent guide rails to pivot around a connecting pivot pin and thereby increase or decrease the gap between adjacent guide rails.

The tenter clips pivotally connected together form a tenter chain. The clips ride against the working surfaces and return surfaces of the guide rails which form a guide path. The tenter clips located in the oppositely located guide rail paths grasp the edges of the webs being treated and convey these webs across the tenter frame.

Thermoplastic film is commonly stretched in the transverse direction by use of such tentering means. The tenter clips passing from one guide rail section to the pivotally connected adjacent guide rail section encounter a gap between adjacent guide rail sections. This gap causes the tenter clip to jar, jump and shockingly abut the opposite edges of the gap and in general hinder the smooth gentle passage of the tenter clips around the, respective, guide rail paths.

The jarring causes a ripple and thereby the destruction of a section of the thermoplastic film web. The jumping hinders the speed of movement of the tenter chain in the guide path. The shocking physically destroys both the guide path and the tenter clips and significantly increases the requirement of the driving motor. The gap also causes the tenter chain to vibrate. The result is nonuniformity of product, web breaks, and a major cause of equipment failure.

OBJECTS OF THE INVENTION

Accordingly, it is an object of the present invention to obviate the gap between guide rail sections.

Other objects of the present invention will be pointed out in part and become apparent in part in the following specification and claims.

BRIEF DESCRIPTION OF THE DRAWINGS

Referring to the drawings in which similar characters of reference indicate corresponding parts in all the figures:

FIG. 9 is a fragmentary perspective view of the guide rail section (shown in FIG. 5) pivotally attached to a saddle which is slidably mounted upon a cross member;

FIG. 10 is an enlarged view, partly in cross-section, of pivotally connected adjacent guide rail sections, showing the gap between the ends of guide rail sections, and one form of the present invention which obviates the gap for the traveling tenter clips;

FIG. 12 is a perspective view of the modified form of gap crossing mechanism, per se, shown in FIG. 11;

DESCRIPTION OF THE PREFERRED EMBODIMENTS

In proceeding with this invention, reference is made to the drawings, wherein is illustrated the new and improved tenter frame gap crossing mechanism.

Figure 4:
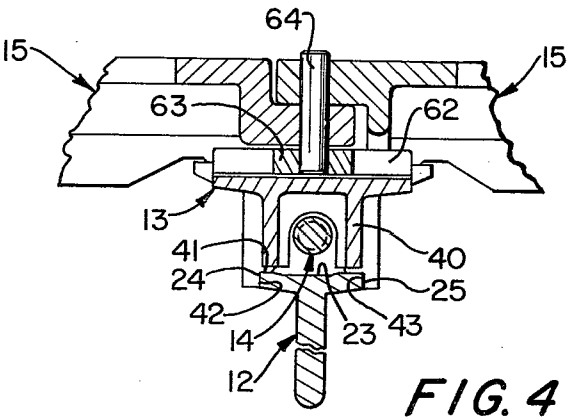
FIG. 4 is a fragmentary cross sectional view taken on line 4—4 of FIG. 1, showing the pivotal mechanism between adjacent guide rail sections.

The tenter frame comprises major structural sections, all generally indicated as follows: A plurality of stands 10 in FIG. 2, a frame 11 in FIGS. 1 and 2, with cross members 12 in FIGS. 1, 4 and 9, a plurality of saddles 13 in FIGS. 2, 4 and 9, a plurality of shafts 14 in FIGS. 1, 2, 4 and 9, and a plurality of pivotally connected guide rail sections 15 in FIGS. 1, 2, 3, 4, 5, 8, 9, 10, 11, 13, 14, 15, 18, 19 and 20.

Stands 10 consist of a unitary structure 16 having a base 17 and top surface 18 (see FIG. 2), to be used in a plurality of units in a horizontal line, and in a plurality of units in a longitudinal line, oppositely disposed unit for unit with the first horizontal line.

The frame 11 consists of a left side 20 and a right side 21 fastened, respectively, to the stands 10 arranged in the, respective, longitudinal line. Cross members 12 are fastened on opposite ends to left side 20, and right side 21. Cross members 12 are provided with a horizontal top sliding surface 23 and two opposite and parallel sliding surfaces 24 and 25. (see FIG. 9). A plurality of left side bearings 26 are fastened to left side 20. A plurality of right side bearings 27 are fastened to right side 21 and are located opposite and parallel to bearings 26, respectively. A plurality of center bearings 28 are fastened to the, respective, cross members 12 in alignment with the, respective, left side 26 and right side 27 bearings.

A plurality of shafts 14, each provided with a left hand thread 31 and a right hand thread 32 are rotatably mounted on opposite ends in the, respective, left side bearings 26, right side bearings 27 and centrally in center bearings 28.

A plurality of hand wheels 33 are provided, with one hand wheel fastened to one end of each shaft 14.

A plurality of saddles 13, two for each cross member 12, are provided with a body 40 having sliding faces 41 and sliding ends 42, 43, to slidingly engage, respectively, top sliding surface 23 and opposite and parallel sliding surfaces 24, 25.

Figure 13:
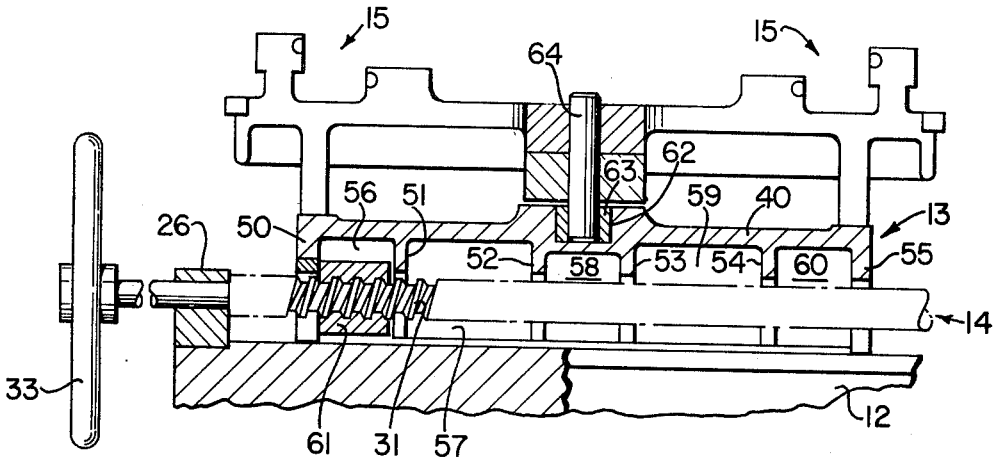
FIG. 13 is a fragmentary vertical cross sectional view taken on line 13—13 of FIG. 1 with the adjacent section omitted.

With reference to FIG. 13, saddle body 40 is provided with a plurality of inverted "U" shaped projections 50, 51, 52, 53, 54 and 55 which form chambers 56, 57, 58, 59 and 60. Inverted "U" shaped projections 50, 51, 52, 53, 54, 55 straddle shaft 14 to allow shaft 14 to freely rotate. A nut 61 provided with a screw thread of a hand adapted to rotatively engage left hand thread 31 or right hand thread 32, is located in chamber 56 and is held therein by means of inverted "U" shaped projections 50, 51.

Rotation of hand wheel 33 causes nut 61 to engage either inverted "U" shaped projection 50 or 51 to slide saddle 13 upon cross member 12 toward or away from center bearing 28.

With reference to FIGS. 9 and 13, saddle body 40 is provided with a longitudinal groove 62. A block 63 is slidably mounted in longitudinal groove 62. A pivot pin 64 is fastened in block 63.

The plurality of pivotally connected, grooved guide straight rail sections 15, are each provided with two tenter clip tracks, vis, a working side track 66 and a return side track 67. Each rail section 15 has a pivotal recess 68 on one end and a pivotal tongue 70 on the opposite end. (see FIGS. 1, 9 and 10.) Pivotal tongues 70 are adapted to pivotally engage pivot pins 64 and lie in the, respective, pivotal recess 68. In this manner a plurality of pivotally connected straight or longitudinally grooved guide rail sections 15 provide a left side guide path, generally indicated at 72, (in FIG. 1) for tenter clips formed into a closed loop circulating tenter chain and a similar right side guide path, generally indicated at 73.

Figure 3:
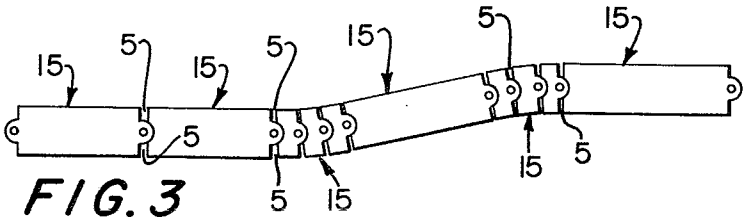
FIG. 3 is a diagrammatic view illustrating the relative position of the guide rail sections in parallel and divergent positions and showing the discontinuous boundaries or gaps between sections.

The diagrammatic view, FIG. 3, shows that the guide rail sections 15, while constituting straight sections, may constitute straight sections of varying lengths so that in pivoted relationship, gaps 5 of varying widths exist between adjacent guide rail sections 15. As will presently appear, the shafts 14 and saddles 13 adjust the guide rail sections 15 in divergent and convergent relationship to provide curved paths for the tenter clip chains.

The two guide paths 72, 73 provide an infinite variety of curves which are equal but opposite for processing web material gripped on opposite sides by the tenter clips of the, respective, tenter chains.

The tenter frame is provided with two driving sprockets 120, 121 (see FIG. 1), driven by motors 122, 123 by means of shafts 124, 125, respectively, and two driven sprockets 126, 127. Tentering chain 111 is operatively connected to sprockets 121, 127. Tentering chain 110 is operatively connected to sprockets 120, 126. Tentering chains 110, 111 are driven in the direction of arrows "A" and "B".

In operation, the movement of tenter chains 110, 111 in guide paths 72, 73, respectively, carry a web to be stretched from the pick up end or web receiving region of the tenter frame between sprockets 126, 127 to the delivery end or web discharge region of the tenter frame between sprockets 120, 121. Suitable cams 120A, 121A engage upstanding arms 130 of the pivot jaws 90 causing lower edges 91 to swing away from base 81 and disengage the web (not shown). At the web receiving region cams 126A, 127A engage arms 130 to pivot jaws 90 away from base 81. As arms 130 of the tenter clips of chains 110, 111 move in the direction of arrows A and B, the arms 130 disengage cams 126A, 127A to release pivoted jaws 90 to the action of gravity to grip the web between bases 81 and lower edges 91. Pin 198 pivotally connects jaw 90 to tenter clip body 300.

Rotation of hand wheels 33 cause the, respective, saddles 13 to slide upon cross members 12, whereby, the guide rail sections 15 and the tenter clip tracks 66, 67 thereby provided, are moved in relation one to the other to provide a preselected path of movement for the respective tenter clip chains 110, 111. That preselected path is under very close tolerance adjustment due to threads 31, 32 on shafts 14. FIGS. 1, 2, 3, 10 and 11 clearly illustrate the gap 5 or space between adjacent divergent guide rail sections 15. The gap 5 must permit the tenter clip to pass from one guide rail section to the adjacent divergent guide rail section, smoothly and without the slightest jar or vibration or the plastic film in a heat softened condition will have imparted to it, a wrinkle, a ridge or a tear.

Figure 5:
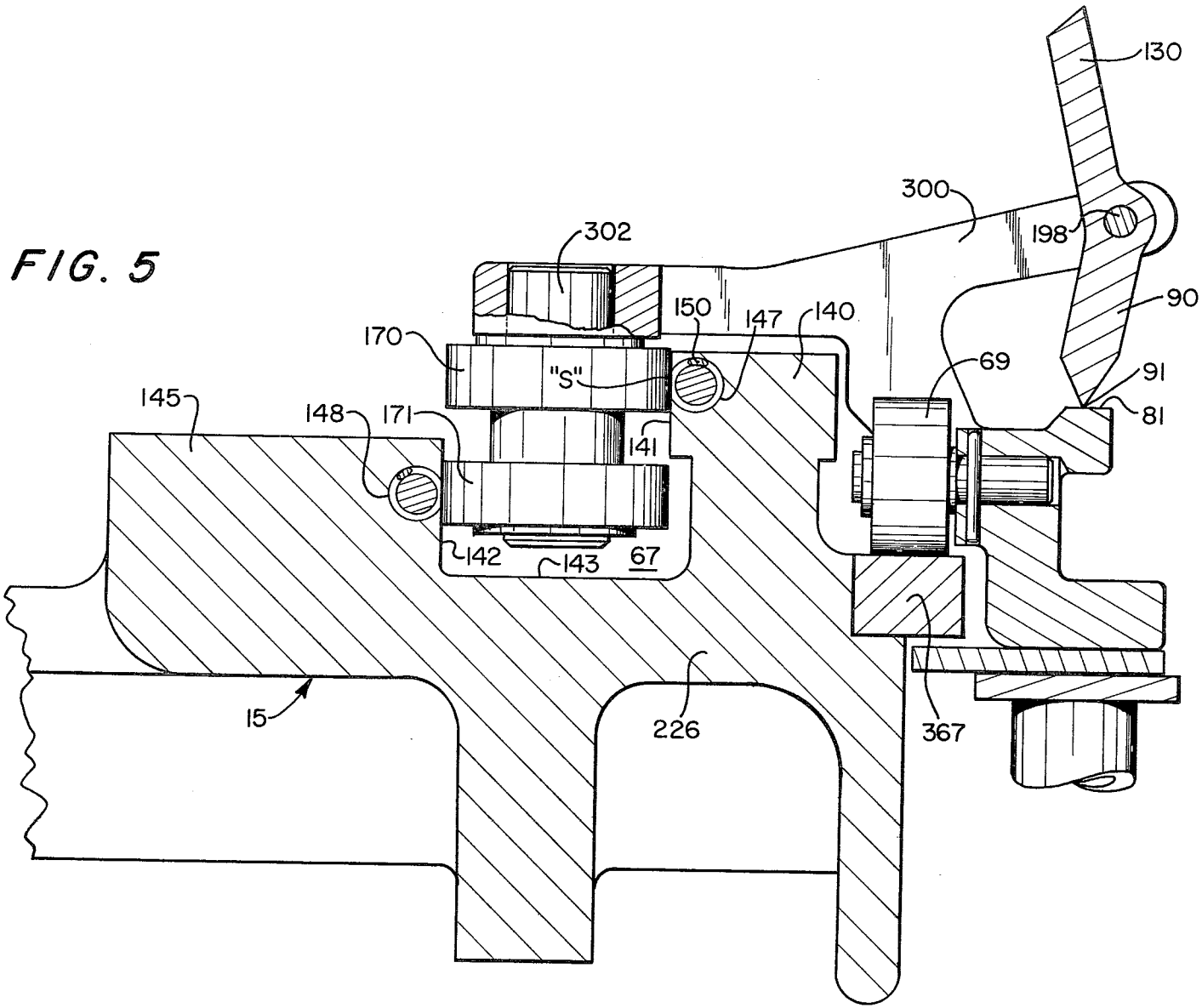
FIG. 5 is a fragmentary cross sectional view, taken on line 5—5 of FIG. 1; showing one form of a guide rail; and one style of tenter clip.

One form of guide rail section 15 construction is shown in FIGS. 5, 9 and 10 wherein the guide rail section comprises a tenter clip working side 225, a tenter clip return side 226 connected together on opposite ends by a front rib 227 and a rear rib 228. Working side 225 is provided with a working side depending arm 230 having a first supporting face 131 and a depending first rib 132. Return side 226 is provided with a return side depending arm 133 having a second supporting face 134 and a depending second rib 135. Working side 225 is provided with a working side track 66 comprising a front flange 136 having an upper forward tenter clip engaging face 137, a rear flange 229 having a lower rear tenter clip engaging face 138 and a base 139, which combine to form a "U" shaped grooved track 66. Similarly, body 226 is provided with a return side track 67 comprising a front flange 140 having an upper forward tenter clip engaging face 141, a rear flange 145 having a lower rear tenter clip engaging face 142 and a base 143, which combine to form a "U" shaped grooved track 67.

Front flange 136 is provided on opposite ends with chambers 144, 144A having, respectively, a window in upper forward working face 137. Similarly, front flange 140 is provided on opposite ends with chambers 147, 147A having, respectively, a window in upper forward working face 141.

Rear flange 229 is provided on opposite ends with chambers 146, 146A having, respectively, a window in lower rear working face 138. Similarly, rear flange 145 is provided on opposite ends with chambers 148 having, respectively, windows in lower rear working face 142.

Reference is made to FIGS. 5 and 10, wherein a coil spring 150 having a flat tenter clip engaging surface "S" is located on opposite ends in a rear chamber 144 and a front chamber 144A provided in opposite ends of pivotally connected adjacent guide rail sections 15. A first dowel pin 160, shorter in length than rear chamber 144 is inserted into one end of coil spring 150. A tapered ended dowel pin having a medial area 161 is inserted into the medial area of coil spring 150. A second dowel pin 162 shorter in length than front chamber 144A is inserted into the other end of coil spring 150. A first space 163 is provided between the end of first dowel pin 160 and one end of tapered ended dowel pin 161. A second space 164 is provided between the end of second dowel pin 162 and the other end of tapered ended dowel pin 161. A first set screw 165 rotatably fastened in rail 15 secures one end of coil spring 150 in rear chamber 144 by forcing the coils against dowel pin 160. A second set screw 166 rotatably fastened in rail 15 secures the opposite end of coil spring 150 in front chamber 144A by forcing the coils against dowel pin 162.

The medial area 161 reinforces coil spring 150 at the gap to support the spring when a tenter clip rides across flat tenter clip engaging surface "S".

In like manner a coil spring 150A is located in rear and front chambers 146, 146A respectively, provided in opposite ends of pivotally connected adjacent guide rail sections 15. With first dowel pin 160A and second dowel pin 162A inserted, respectively, in opposite ends of coil spring 150A. A tapered ended dowel pin 161A is inserted into the medial area of coil spring 150A. First set screw 165A and second set screw 166A, rotatably fastened in adjacent rails 15, secure one end of coil spring 150A in rear chamber 146 at the dowel pin 160A and the other end of spring 150A in front chamber 146A at the dowel pin 162A.

Figures 6, 7, 8, 14:
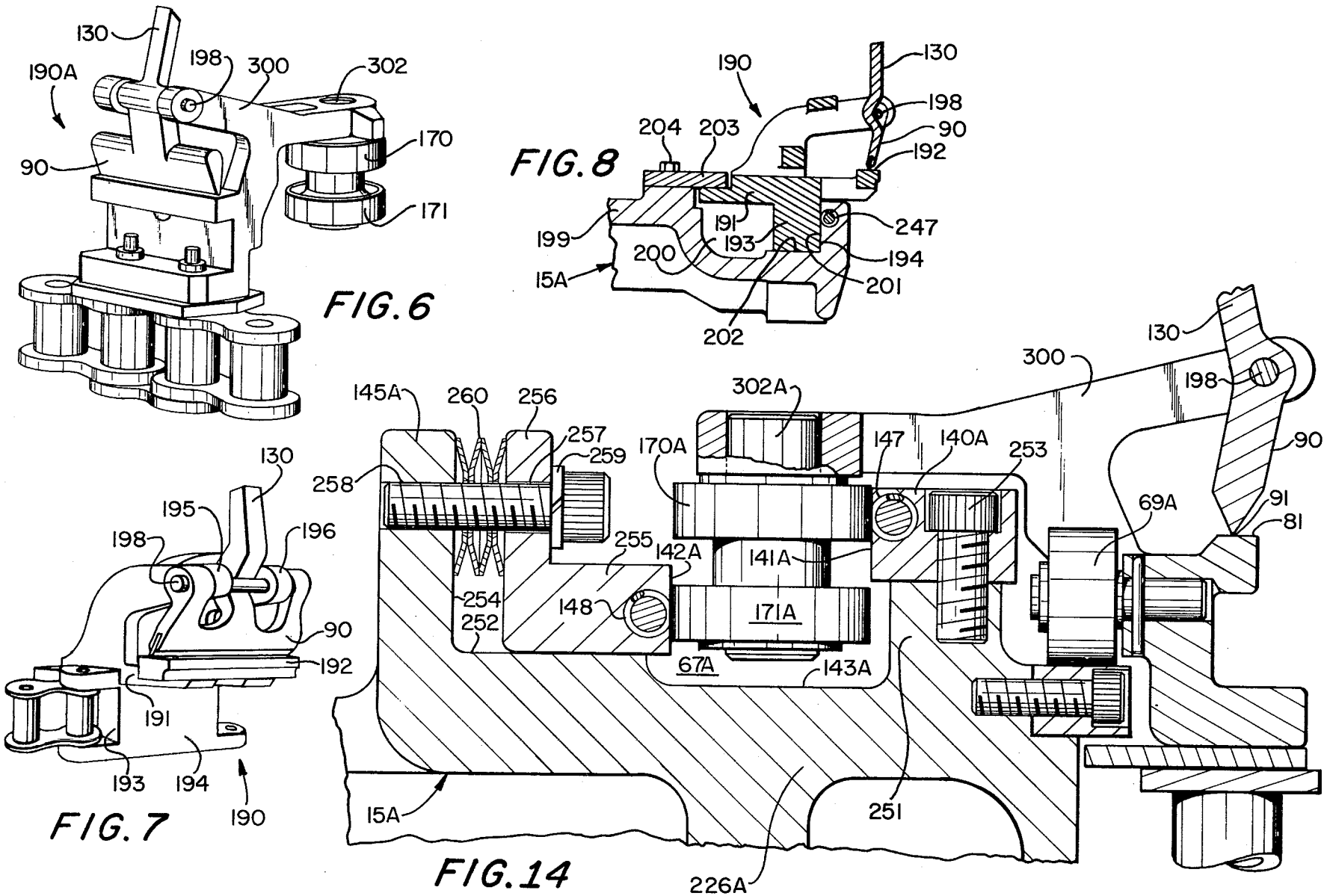
FIG. 6 is a perspective view of another form of tenter clip adapted to ride in the track provided by the guide rail section shown in FIG. 5.
FIG. 7 is a perspective view of still another form of tenter clip.
FIG. 8 is a vertical cross-sectional view showing the tenter clip of FIG. 7 riding in a guide rail having a modified form when compared to the guide rail shown in FIG. 5.
FIG. 14 is a vertical cross sectional view similar to FIG. 5 showing a modified form of guide rail construction.

The tenter clip shown in FIGS. 5 and 6 is provided with an upper roller 170 and a lower roller 171, both rollers are rotatively mounted to a shaft 302 held in tenter clip body 300. Reference is made to FIGS. 5 and 10, as rollers 170, 171 ride against working faces 141, 142, respectively, they encounter the gap 5 now closed by coil springs 150, 150A as a continuation of working faces 141, 142, respectively. In this manner, the rollers 170, 171 smoothly pass from one rail 15 to the adjacent rail 15 without jar.

The coil springs 150, 150A fastened in the respective chambers, expand and contract with the opening and closing of gap 5.

The rails 15 are provided with ledges 367, which are complimentary tapered on opposite ends, as at 368, so as to engage with a clearance therebetween when the rails are in alignment.

The style of tenter clip shown in FIG. 5 is provided with a front roller 69. Roller 69 may pass from one ledge 367 to the adjacent ledge 367 without jar due to the complimentary taper of the ends of adjacent rail sections 15, whether the gap 5 is minimal or maximal. There is always a gap between adjacent rail sections 15 to accommodate expansion and contraction of the rail sections 15 when subjected to a heating oven environment.

Figure 11:
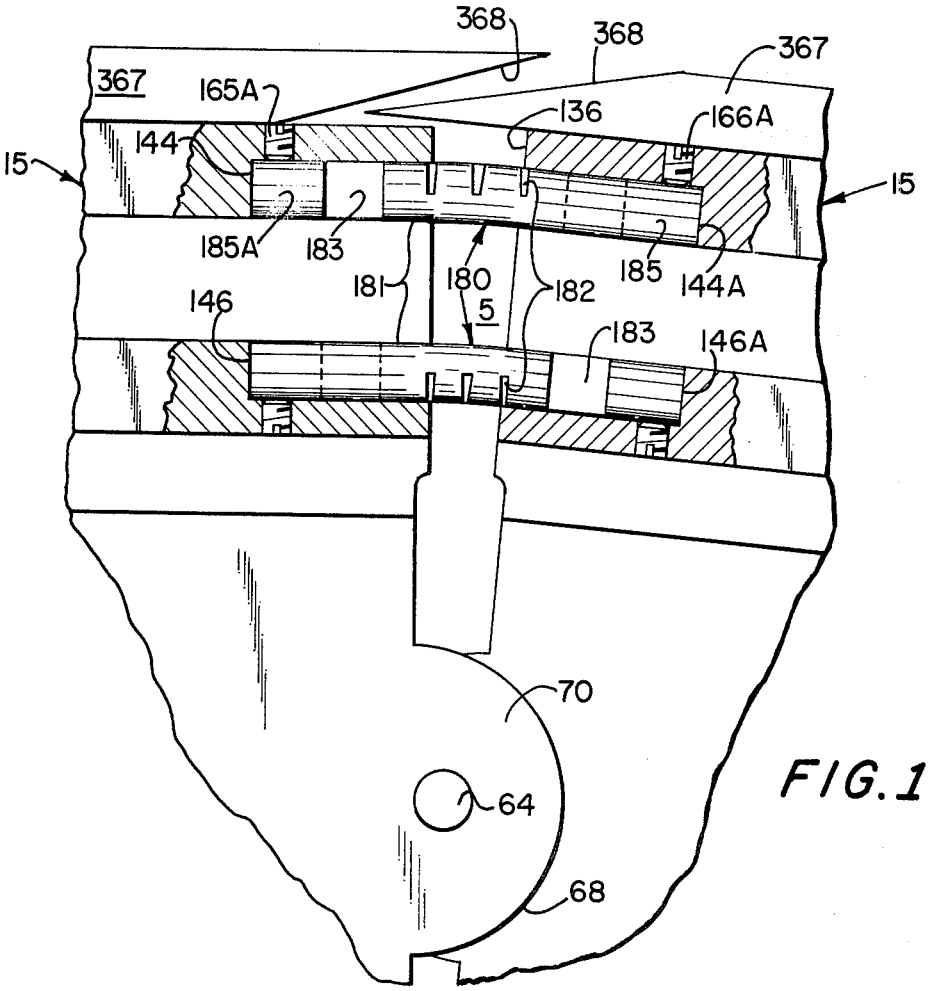
FIG. 11 is a view, similar to FIG. 10, showing a modified form of gap crossing mechanism in position between adjacent guide rail sections.

FIGS. 11 and 12 illustrate a modified form of crossing gap mechanism. Whatever means are used to close the gap 5 between adjacent rail sections, that means must yield to the arcuate relative movement between the ends of adjacent straight guide rail sections.

A bar, generally indicated at 180 comprises two compatible half sections 185, 185A which slidably engage. One face 181 of bar 180 is made flat to provide a tenter clip engaging face. Three (more or less) slits 182 are made in the surface opposite said tenter clip track surface so that bar 180 will bend or yield in an arcuate direction, thereby arcuately shaping flat face 181. The bar 180 is then separated into two opposite but identical half sections, upper 185 and lower 185A, so that each half section has a sliding surface 183, a head 186 and a shoulder 184 formed in the head at the juncture of the sliding surface 183. In this construction, the upper section 185 may slide relative to lower section 185A, when as shown in FIG. 11 the half sections are fastened in chambers 144, 144A by means of set screws 165A and 166A. The slits 182 permit the two sections 185, 185A to yield when the rail sections 15 pivot around pin 64 causing the sections 185, 185A to arcuately bend relative to pivot pin 64 which is the center of the radius of the arc.

Bar 180 functions in the same manner as coil spring 150 in relation to adjacent rail sections 15 and the accommodated tenter clips.

FIGS. 7 and 8 depict a modified form of tenter clip and tenter rail. This form is generally used on material woven from cotton, wool and/or synthetic fibers. The rail and tenter clips shown in FIG. 5 are the form generally used on thermoplastic web material.

Both forms use tenter clips, formed in a pair of closed loops, which travel in a pair of sectionalized grooved guide rail sections arranged in closed loop paths, spaced in parallel relation to provide a uniform distribution of transverse stretching forces.

The tenter clip, generally indicated by reference numeral 190 (see FIGS. 7 and 8) is provided with a horizontal body 191 having a plate 192 and a projection 193 providing a tenter clip engaging face 194. A pair of arms 195, 196 integrally connected to said body 191 overlie plate 192. A pivotal jaw 90 pivotally connected to arms 195, 196 through pin 198, pivotally engages plate 192 through the force of gravity.

Figure 1:
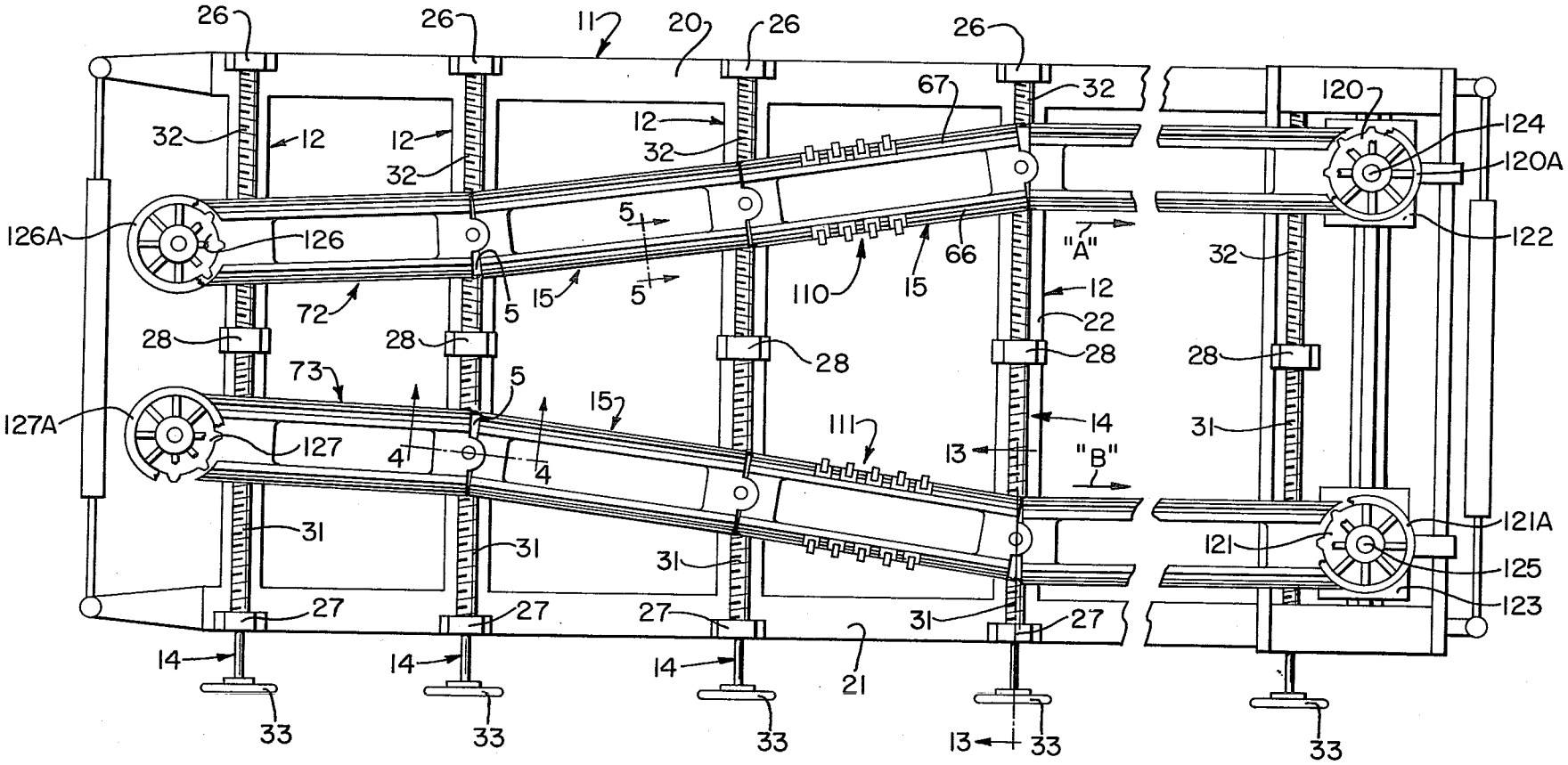
FIG. 1 is a schematic plan view of a tenter frame, showing the pivotally connected guide rail sections, the shafts with left hand and right hand threads and a few tenter clips which form a section of a tenter chain.
Figure 2:
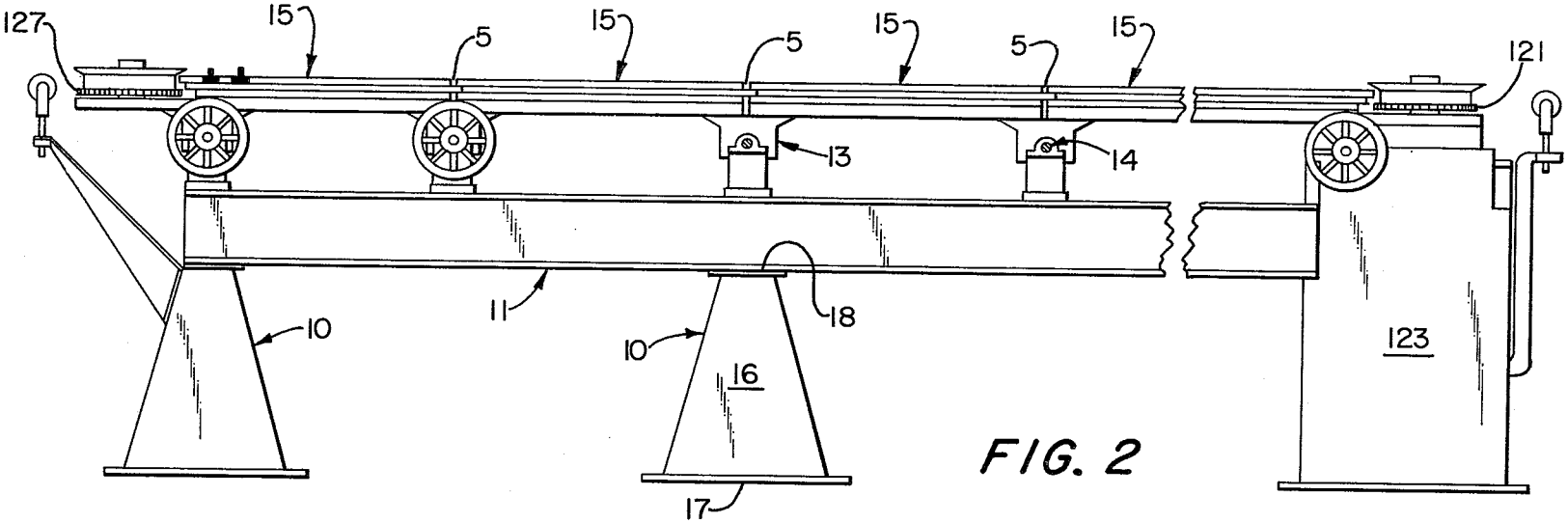
FIG. 2 is a right side elevational view of FIG. 1.

The guide rail section, generally indicated at 15A comprises a body having a groove 200, a tenter clip engaging face 201 and a base 202. The tenter clip 190 is slidably mounted in groove 200, with tenter clip engaging face 194 slidably engaging tenter clip engaging face 201 while being supported upon base 202. A top case 203 is fastened to guide rail section 15A, by means of screws 204, which overlies horizontal body 191 so as to retain tenter clip 190 in groove 200. The tenter clips 190 are pivotally connected into a closed loop as shown in FIG. 1 and operationally described for the specie tenter clip shown in FIG. 5.

Chamber 247 is provided in body 199 and coil spring 150 or bar 180 may be housed therein as previously described in relation to FIGS. 5, 9, 10, 11 and 12.

FIG. 14 depicts a modified form of pivotally connected grooved guide rail section. The structure described in relation to FIG. 5 applies to FIG. 14 with one modification. The reference numerals of FIG. 5 and the description which applies to FIG. 14 have an "A" applied when used on FIG. 14.

Guide rail section 15A having a body 226A is provided with a return side track 67A in the form of a groove formed by a front projection 251, a rear flange 145A and a base 143A. A front projection wear strip 140A having an upper forward tenter clip engaging face 141A is fastened to front projection 251 as by means of screws 253. Rear flange 145 is cut back to provide a seat 252 and a longitudinal surface 254. A rear wear strip comprises a body 255 having an upstanding arm 256 and a lower tenter clip engaging face 142A, is slidably mounted upon seat 252. A plurality of clearance orifices 257 are provided in upstanding arm 256. A plurality of machine screws 258 pass through clearance orifices 257 and are rotatably supported in rear flange 145A. A split washer 259 may be interposed between the head of screw 258 and arm 256. A spring or a compression washer 260 is supported upon screw 258 and interposed between upstanding arm 256 and rear flange 145A to yieldingly urge tenter clip engaging face 142A toward tenter clip engaging face 141A. In this manner, tenter clip rollers 170A and 171A, engaging tenter clip engaging faces 141A and 142A, respectively, are yieldingly held in return side track 67A or in the working side track (not shown because the structure is a duplication of track 67A).

Front flange wear strip 140A being a part of the pivotally connected grooved guide rail section 15A is provided on opposite ends with chambers 147 and 147A as described in structure and purpose with reference to FIGS. 5, 10, 11 and 12.

Similarly, wear strip body 255 being a part of the same pivotally connected grooved guide rail section 15A is provided on opposite ends with chambers 148, 148A as described in structure and purpose with reference to FIGS. 5, 10, 11 and 12.

Reference is now made to FIGS. 15, 16, 17, 18 and 19 wherein is depicted a modified form of gap crossing mechanism as applied to the pivotally connected grooved guide rail sections described in relation to FIG. 14. The structural features in FIG. 19 corresponding to the identical structural features described with reference to FIG. 14 will have a suffix "C" added to the reference numerals.

The form of pivotally connected grooved guide rail sections 15C shown in FIGS. 15 through 19, comprise a body 226C having a return side track 67C in the form of a groove formed by a front projection 251C, a rear flange 145C and a base 143C. Body 226C terminates on opposite ends in an edge E. (see FIG. 15).

The tenter clip working side of rail section 15C is identified as 66C and the tenter clip return side is identified as 67C which are connected together on opposite ends by a front rib 227C and a rear rib 228C. As previously described, each rail section 15C has a pivotal recess 68C on one end and a pivotal tongue 70C on the opposite end (see FIG. 15). Pivotal tongues 70C are adapted to pivotally engage pivot pins 64C and lie in the, respective, pivotal recesses.

Each guide rail section 15C is provided with a plurality of front projection wear strips 140C, having an upper tenter clip engaging face 141C. Each wear strip 140C is fastened to front projection 251C as by means of screws 253C. The rear flange 145C is cut-back to provide a seat 252C and a longitudinal surface 254C. A rear wear strip comprises a body 255C having an upstanding arm 256C and a lower tenter clip engaging face 142C, is slidably mounted upon seat 252C. A plurality of clearance orifices 257C are provided in upstanding arms 256C. A plurality of machine screws 258C pass through clearance orifices 257C and are rotatably supported in rear flange 145C. A split washer 259C may be interposed between the head of screw 258C and arm 256C. A spring or a compression washer 260C is supported upon screw 258C and interposed between upstanding arm 256C and rear flange 145C to yieldingly urge tenter clip engaging face 142C toward tenter clip engaging face 141C. Each wear strip body 255C is provided with a plurality of enlarged bolt holes 303. A plurality of bolts 304, one for each bolt hole 303 passes through the, respective, bolt hole 303 and is rotatably mounted in body 226C so that wear strip 255C is able to move laterally and longitudinally. In this manner, tenter clip rollers 170C and 171C, engaging tenter clip engaging faces 141C and 142C, respectively, are yieldingly held in return side track 67C or in the working side track 66C. (see FIG. 15).

Each section "L" (see FIG. 15, 16, 17) of the plurality of front projection wear strips 140C and the rear wear strip body 255C are provided with a lower cut-away or lower shelf on one end 275 and an upper cut-away or upper shelf 276 on the opposite end. In this manner, the upper shelf 276 is slidably mounted upon the lower shelf 275 of the adjacent wear strip for thermal expansion and contraction and pivotal movement.

Figure 15:
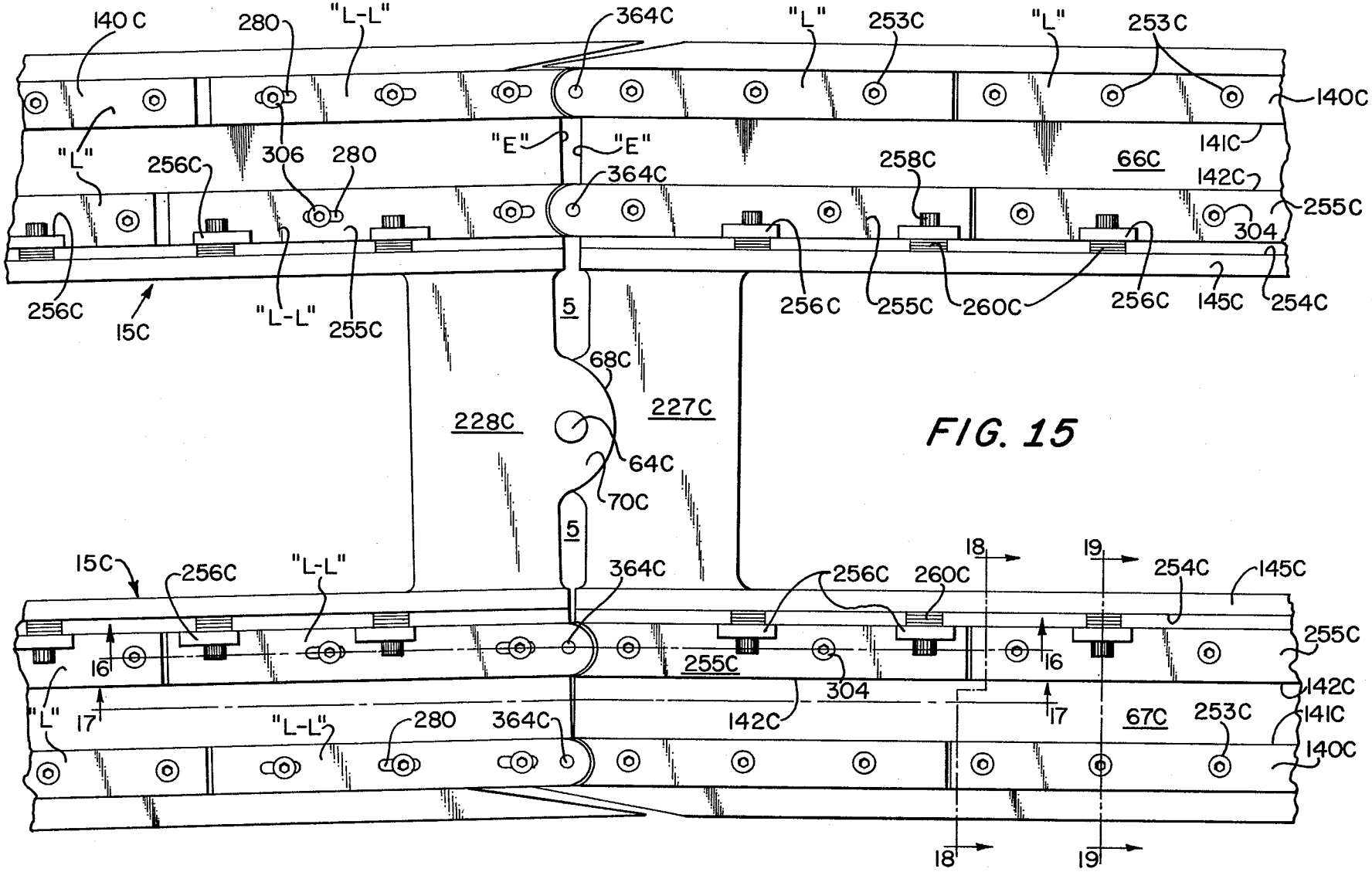
FIG. 15 is a fragmentary plan view of pivotally connected adjacent guide rail sections illustrating another modified form of gap crossing mechanism mounted upon the guide rail shown in FIG. 14.

The last section "L" of the plurality of front projection wear strips 140C and the last section of rear wear strip body 255C are made round (as seen in FIG. 15).

The last section "L—L" of the plurality of front projection wear strips 140C and the last section "L—L" of rear wear strip body 255C are provided with elongated slots 280.

Shoulder bolts 306 pass through elongated slots 280 and are fastened in body 226C.

The upstanding arms 256C attached to sections "L—L" are provided with elongated slots 307 to permit sections "L—L" to move relative to machine screws 258C.

Pivotal movement of guide rail sections 15C relative to each other causes sections "L—L" pivotally connected to an adjacent section "L" on one end, to move laterally relative to the section "L" on the opposite end.

As previously described, hand wheels 33 cause the saddles 13 to slide upon cross members 12, whereby the grooved guide straight rail sections 15C are moved in relation one to the other and thereby, pivot on pivot pins 64C to cause a divergence or convergence of the ends E of adjacent guide rail sections to increase or decrease the gap between adjacent rail sections 15C.

Figure 16:
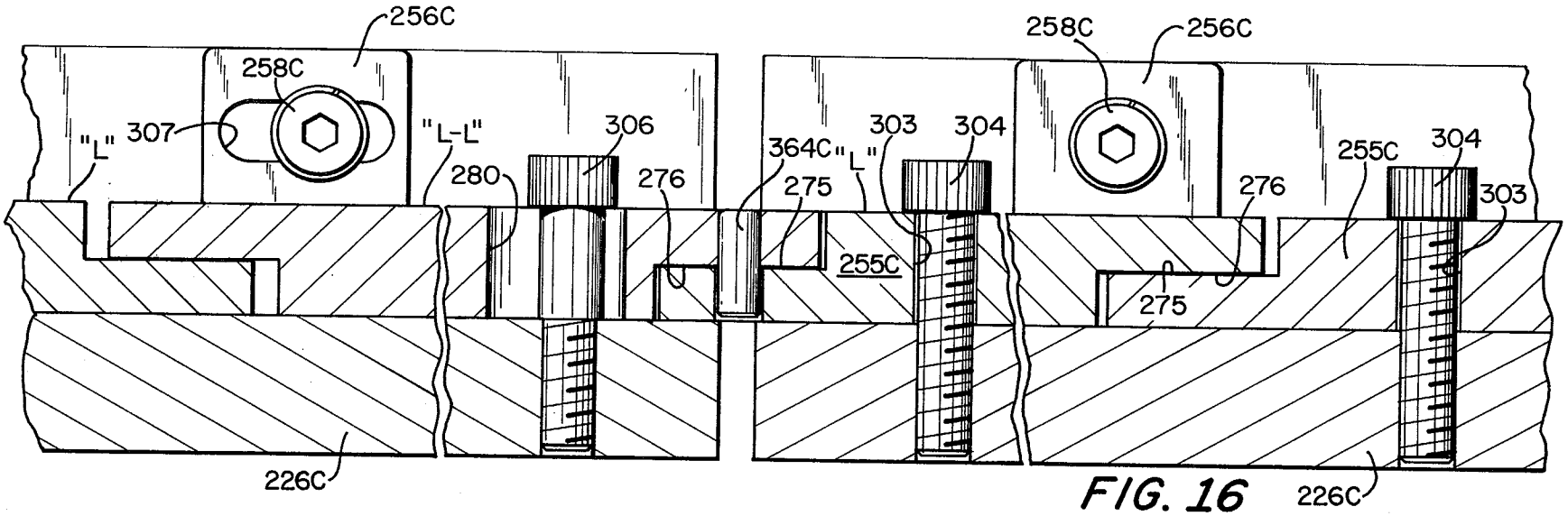
FIG. 16 is a fragmentary vertical cross sectional view taken on line 16—16 of FIG. 15.
Figure 17:
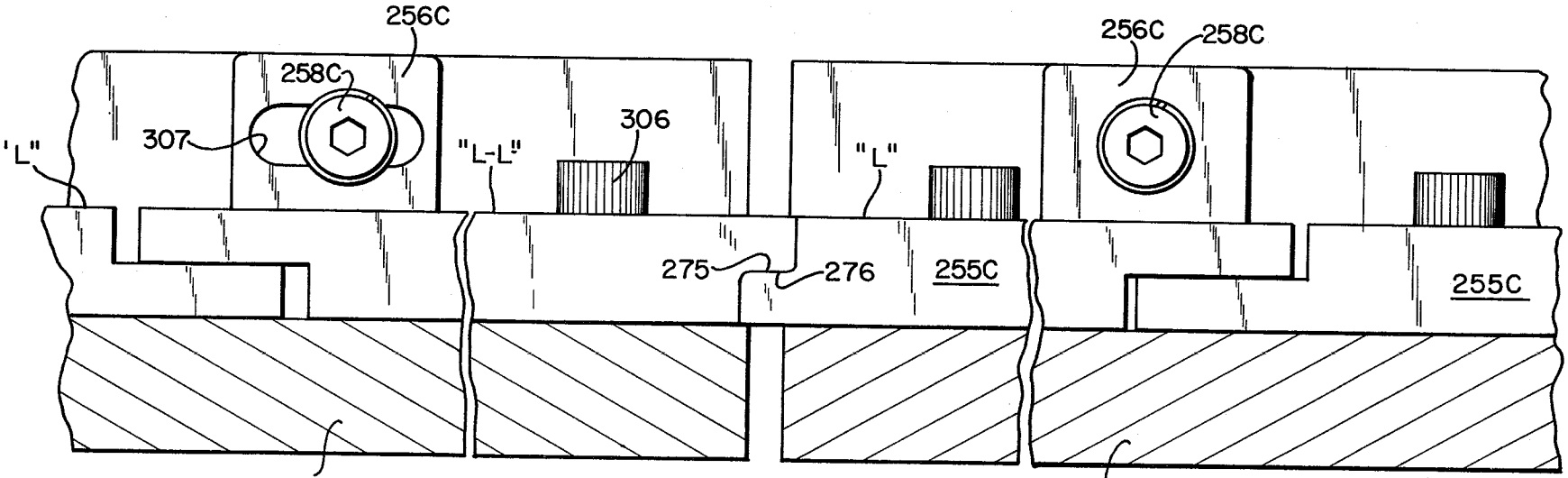
FIG. 17 is a view similar to FIG. 16 taken on line 17—17 of FIG. 15.

As will be noted in FIGS. 15, 16 and 17 wear strip body 255C provided with the elongated slots 280 will slide in relation to the adjacent guide rail sections on opposite ends and will pivot around pivot pin 364C, thereby to provide a smooth arcuate guide rail gap crossing mechanism.

Figure 20:
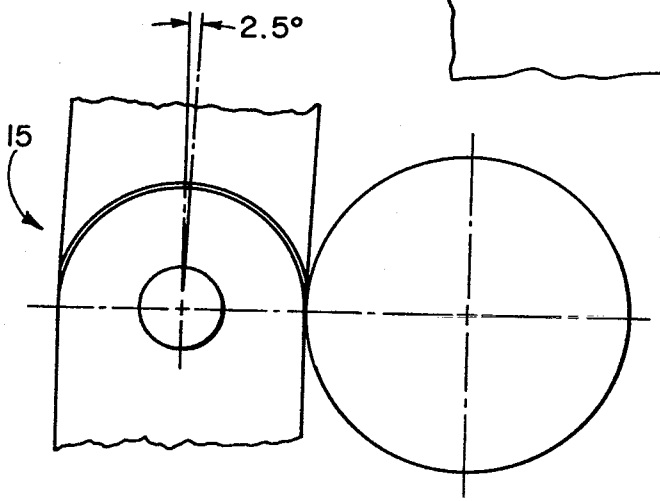
FIG. 20 is a diagrammatic view illustrating the maximum divergence angle between adjacent pivotally connected guide rail sections in accordance with the modified form shown in FIGS. 15 through 19.

FIG. 20 is a diagrammatic view illustrating a roller 170C or 171C riding against the tenter clip engaging face of pivotally connected adjacent grooved guide straight rail sections 15C. Empirically, it is believed that the angle between pivotally connected guide rail sections 15 will approximate two and one-half degrees. This numerical value is an observation and not a limitation.

Figure 18:
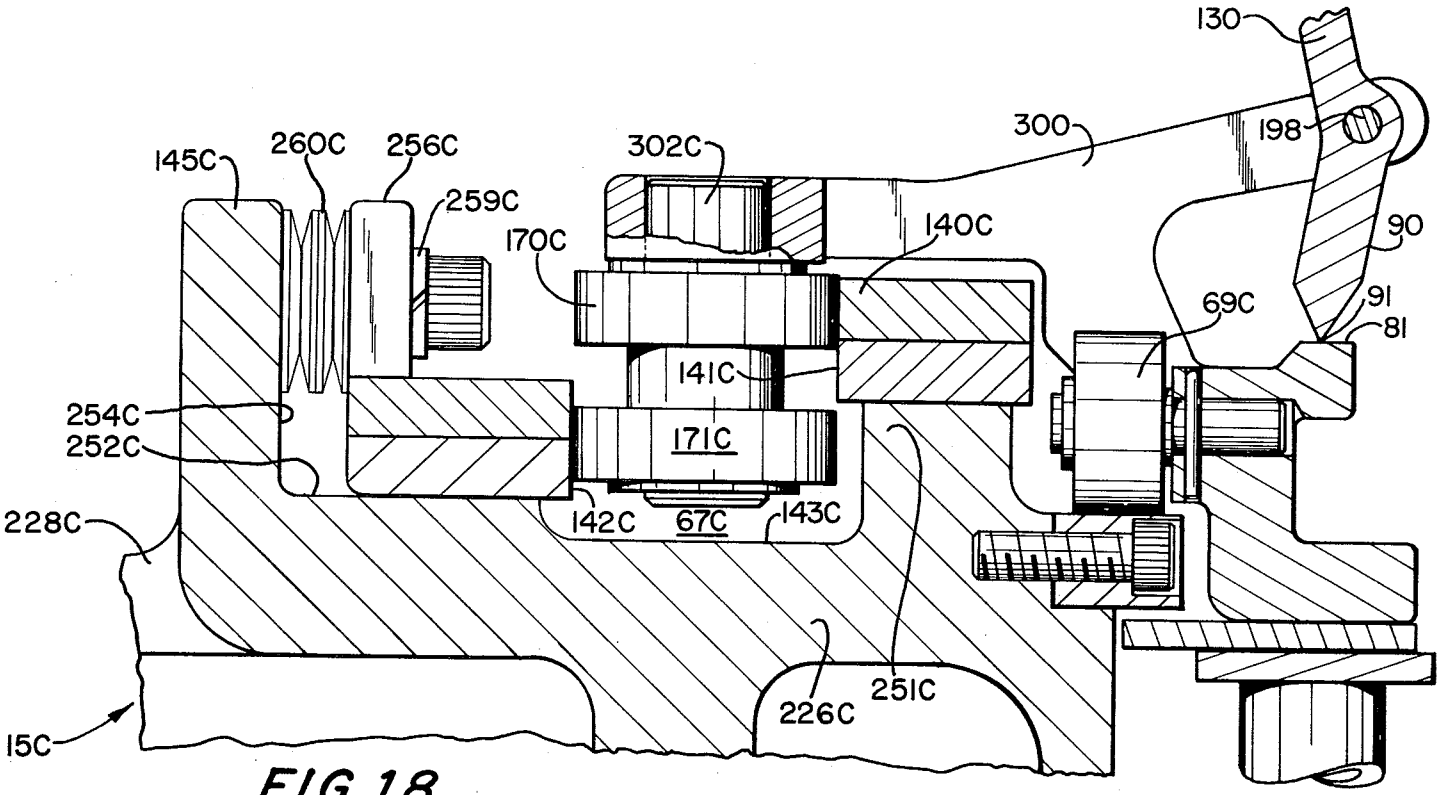
FIG. 18 is a fragmentary cross sectional view, taken on line 18—18 of FIG. 15.
Figure 19:
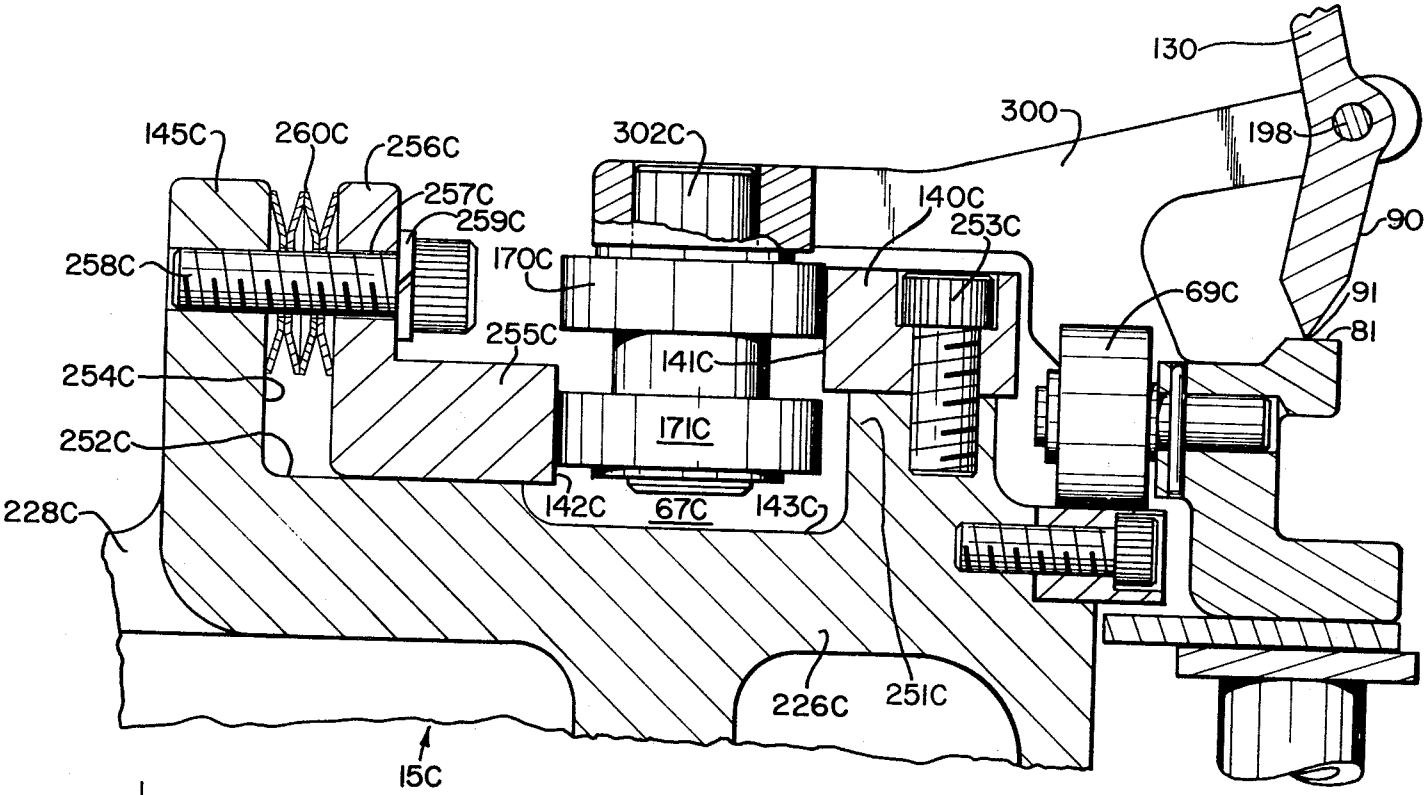
FIG. 19 is a fragmentary vertical cross sectional view, similar to FIG. 18, taken on line 19—19 of FIG. 15.

FIG. 18 illustrates the rollers 170C and 171C engaging the guide rail gap crossing mechanism shown in FIGS. 15, 16, 17 and 19.

Having shown and described preferred embodiments of the present invention, by way of example, it should be realized that structural changes could be made and other examples given without departing from either the spirit or scope of this invention.

What we claim is:

1. Apparatus for stretching web material by use of tentering clips and providing a uniform distribution of transverse stretching forces comprising a frame, a plurality of cross members secured to said frame, a plurality of bearings fastened to each cross member, a plurality of shafts, one for each cross member, each shaft having a right hand thread and a left hand thread, means rotatably mounting said shafts in said plurality of bearings, a plurality of saddles, two for each cross member, means slidably mounting said saddles to said cross members, a plurality of nuts, one secured in each saddle, one nut of one saddle of an associated shaft connected to a right hand thread, alternately, another nut of the other saddle of the shaft connected to a left hand thread, whereby rotation of the shaft in one direction draws the saddles toward each other and rotation of the shaft in an opposite direction separates said saddles, a plurality of blocks, one for each saddle, means slidably mounting a block in each saddle, a plurality of pivot pins, one fastened in each block, a plurality of grooved guide straight rail sections having straight tenter clip engaging faces pivotally mounted to said saddles, with the end of one rail being pivotally mounted to the end of an adjacent rail through said pivot pins, thereby to provide two pivotally connected adjacent grooved guide straight rail sections with a gap therebetween, said plurality of grooved guide straight rail sections forming two closed loop paths to accommodate, respectively, two closed loop tentering chains, said shafts providing incremental adjustment between pairs of rails controlled by the same shaft and incremental adjustment between adjacent rails, that improvement in which means between the ends of adjacent grooved guide straight rail sections provide a gap crossing mechanism, said means yielding on an arc upon relative pivotal movement between adjacent grooved guide straight rail sections, said means providing a smooth arcuate connection between the straight tenter clip engaging faces having various degrees of diverging and converging relationship with respect to one another, said plurality of pivotally connected adjacent grooved guide straight rail sections each having a body provided with a front projection, and a rear flange, a plurality of front projection wear strips having a tenter clip engaging face, screw means fastening said wear strips to said front projection, the wear strips on opposite ends of each front projection having a lower shelf and an upper shelf, respectively, and each shelf having a rounded end, the lower shelf of one front projection wear strip slidingly engaging the upper shelf of an adjacent front projection wear strip, pivot pin means pivotally connecting an upper shelf to a lower shelf to provide an arcuate tenter clip engaging face across the gap between adjacent pivotally connected straight rail sections, said rear flange having a cut-back to provide a seat, and a longitudinal surface, a plurality of rear wear strips, each wear strip comprising a body having an upstanding arm and a lower tenter clip engaging face, means slidably mounting said plurality of rear wear strips to said rear flange for sliding movement, longitudinally and laterally, to said seat, said rear wear strips on opposite ends of said rear flange having a lower shelf and an upper shelf, respectively, and each shelf having a rounded end, the lower shelf of one rear strip slidingly engaging the upper shelf of an adjacent rear wear strip, pivot pin means pivotally connecting an upper shelf to a lower shelf to provide an arcuate tenter clip engaging face between adjacent pivotally connected grooved guide straight rail sections.

* * * * *